US008365651B2

(12) United States Patent
Dorr

(10) Patent No.: US 8,365,651 B2
(45) Date of Patent: Feb. 5, 2013

(54) PISTON-TYPE ACCUMULATOR

(75) Inventor: Walter Dorr, Völklingen (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 1515 days.

(21) Appl. No.: 10/542,781

(22) PCT Filed: Jan. 17, 2004

(86) PCT No.: PCT/EP2004/000335
§ 371 (c)(1),
(2), (4) Date: Jul. 20, 2005

(87) PCT Pub. No.: WO2004/081388
PCT Pub. Date: Sep. 23, 2004

(65) Prior Publication Data

US 2006/0075892 A1 Apr. 13, 2006

(30) Foreign Application Priority Data

Mar. 11, 2003 (DE) ..... 103 10 428

(51) Int. Cl.
*F01B 31/12* (2006.01)

(52) U.S. Cl. ..... 92/5 R

(58) Field of Classification Search ..... 92/5 R
See application file for complete search history.

(56) References Cited

U.S. PATENT DOCUMENTS

| | | | | |
|---|---|---|---|---|
| 2,976,845 | A * | 3/1961 | Goldring | 91/4 A |
| 3,636,824 | A * | 1/1972 | Clark | 92/258 |
| 4,608,870 | A | 9/1986 | Huber et al. | |
| 4,644,976 | A * | 2/1987 | Peter et al. | 138/31 |
| 4,793,241 | A * | 12/1988 | Mano et al. | 92/5 R |
| 5,201,838 | A | 4/1993 | Roudaut | |
| 6,346,806 | B1 * | 2/2002 | Schabuble et al. | 324/207.14 |

FOREIGN PATENT DOCUMENTS

| | | | |
|---|---|---|---|
| DE | 3411367 | A1 | 10/1985 |
| DE | 195 39 551 | A1 | 4/1997 |
| DE | 101 43 675 | A1 | 2/2003 |
| EP | 0 721 067 | A2 | 7/1996 |
| JP | 11132204 | | 5/1999 |
| JP | 2001082416 | | 3/2001 |

* cited by examiner

*Primary Examiner* — F. Daniel Lopez

(74) *Attorney, Agent, or Firm* — Roylance, Abrams, Berdo and Goodman L.L.P.

(57) ABSTRACT

A piston-type accumulator has: a) an accumulator housing in the form of a cylinder tube (1) made of magnetizable material, which defines an axial direction of the housing; b) a piston (3), which can be axially displaced over a stroke path inside the cylinder tube (1) and which forms a moving separating element that, inside the accumulator housing, separates two working spaces (7 and 9) from one another; c) a magnet arrangement (29, 31, 35), placed on the piston (3) and generating a field on the wall of the cylinder tube (1), and; d) a magnetic field sensor device located on the exterior of the cylinder tube (1) and having at least one Hall sensor (51). The Hall sensor is mounted on the exterior of the cylinder tube (1) and responds to the field generated by the magnet arrangement (29, 31, 35) on the piston (3) to determine the position of the piston (3) along the stroke path.

14 Claims, 2 Drawing Sheets

PISTON-TYPE ACCUMULATOR

FIELD OF INVENTION

The present invention relates to piston-type accumulators such as are provided, among other things, in conjunction with hydraulic assemblies for holding specific volumes of a pressurized fluid (such as a hydraulic medium) and supplying the pressurized fluid to this assembly when required. Hydropneumatic (gas-impinged) accumulators are used nowadays in most hydraulic assemblies. The movable separating element inside the accumulator housing separates a fluid space as one operating space from a gas storage space as the other operating space. Nitrogen gas is regularly employed as the operating gas. The piston forming the gas-tight separating element to a great extent allows separation of gas supply space from fluid space.

BACKGROUND OF THE INVENTION

The fluid component communicates with the hydraulic circulation of the assembly so that the accumulator receives fluid as the pressure rises and the gas is compressed. When the pressure drops, the compressed gas expands and forces the pressurized fluid stored back into the hydraulic circulation. The changes in the volume of gas supply space and liquid supply space result in an appropriate axial movement of the piston inside the accumulator housing.

A prerequisite for flawless behavior of piston-type accumulators is that the gas charging pressure prevailing in the gas supply space has a value adapted to the level of pressure of the fluid component, so that the piston is in a suitable position inside the cylinder housing. The piston may execute the operating movements required in the axial direction between the end positions in the accumulator housing.

SUMMARY OF THE INVENTION

An object of the present invention is to provide a piston-type accumulator permitting fixing the amounts of the volumes of the operating spaces during operation and accordingly to determine the position of the piston by simple means.

This object is attained according to the present invention by a piston-type accumulator permitting contact-free indication through the wall of the accumulator housing of the position of the piston, so that simple and reliable monitoring of the operating state of the accumulator during operation is possible.

For the invention, at least one, and preferably two, Hall sensors are provided as magnetic field sensors which respond to changes in the field resulting from piston movements. An electric signal is made available for indication of the piston position. This arrangement creates advantageous options for configuration of the position display, for example, in the form of a signal-controlled optical and/or acoustic display, optionally also in the form of a remote display.

In advantageous exemplary embodiments the piston is made of a non-magnetizable material. The magnet configuration has a plurality of permanent magnets mounted at a radial distance from the circumference of the piston in a row concentric with the longitudinal axis of the piston, with reciprocal polarity so that their polar axes extend in parallel with the longitudinal axis.

With the polar axes in such a position, introduction of the magnetic flux into the wall of the cylindrical tube formed of a magnetizable material results in a field line pattern such that a high proportion of the field lines extends longitudinally. Piston movements in one or the other axial direction consequently result in significant signal changes caused by the Hall effect as a result of approach to one or the other Hall sensor.

In one especially advantageous exemplary embodiment, the permanent magnets are retained on the piston between ring elements of magnetizable material which adjoin the pole ends of the permanent magnets. These ring elements of magnetizable material may be configured so that parts of their circumferential areas are moved into the proximity of the interior wall of the cylindrical tube and form pole shoes for introduction of magnetic flux into the wall of the cylindrical tube.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
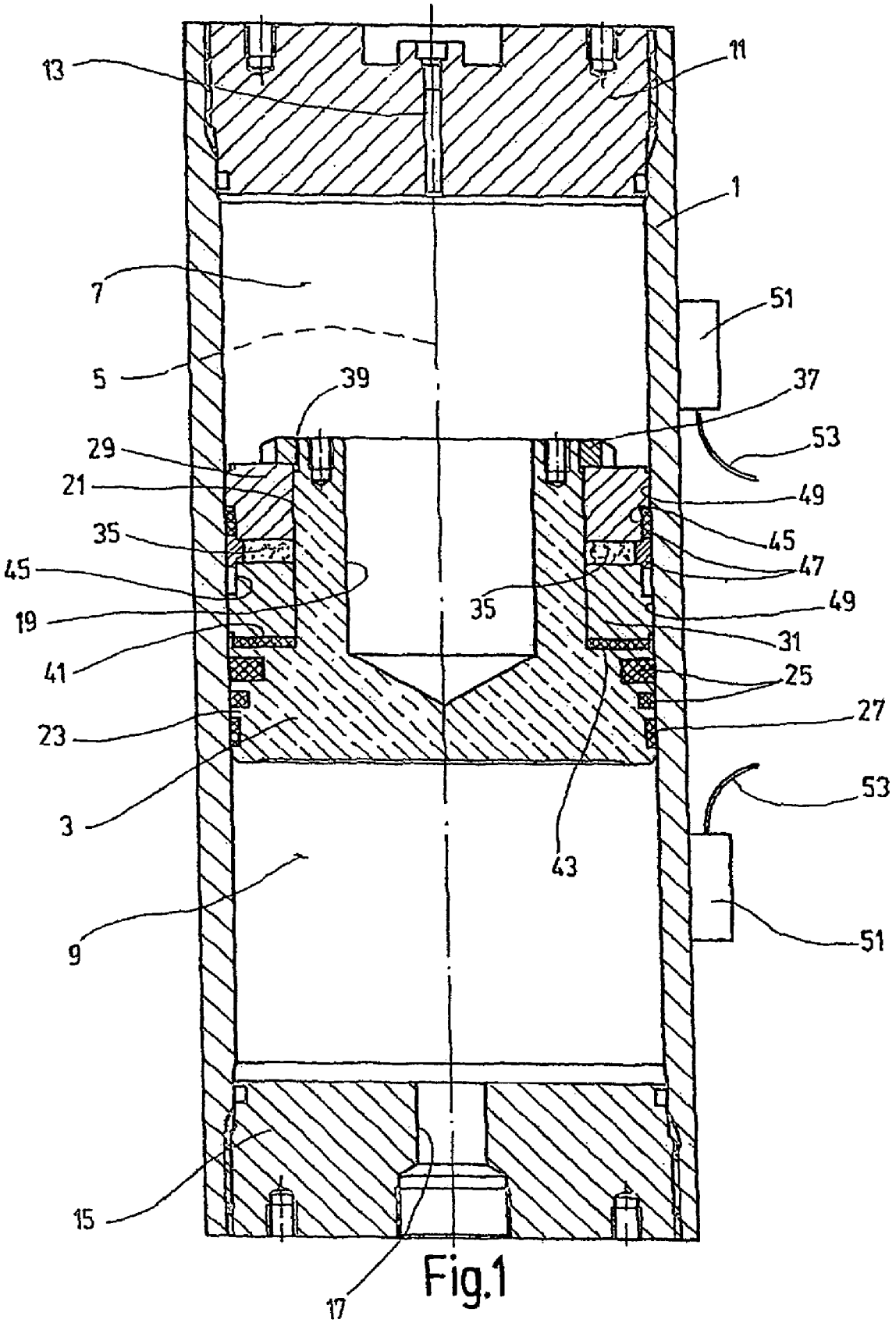
FIG. 1 is a simplified side elevational view in section of a piston-type accumulator according to one embodiment of the present invention.

The accumulator housing of the exemplary embodiment shown in the drawings of the piston-type accumulator according to the present invention has a cylindrical tube 1 of a magnetizable material such as a steel alloy. In the cylindrical tube 1, a piston 3 of a non-magnetizable material (special steel) or an aluminum alloy or the like is provided. This piston may be moved back and forth in the axial direction, which is represented by a longitudinal axis 5. The piston 3 acts as movable separating element between two operating spaces present in the cylindrical tube 1, in the exemplary embodiment a gas storage space 7 and a hydraulic fluid space 9.

The cylindrical tube 1 is closed off on the end closing off the gas storage space 7 by a threaded cylinder cover 11. A gas channel 13, to which a gas valve or a charging fitting (neither of which is shown) may be connected, extends through cover 11 into the cylindrical tube 1. Similarly, the cylindrical tube 1 is closed off on the end associated with the fluid space 9 by a threaded cover 15, which has a central fluid passage 17.

The piston 3 has a trough-like depression 19 which is concentric with the axis 5 and is open on the end of the piston facing the gas storage space 7 so that it increases the volume of the gas storage space 7. On the end of the side of the piston having the open end of the depression 19, the piston 3 has a circumferential section 21 which extends opposite an adjoining circumferential section 23 to the end of the piston facing the fluid space 9 and which is of a smaller exterior diameter. The exterior diameter of this circumferential section 23 is adapted to the interior diameter of the cylindrical tube 1 so that it fits on the inside of the cylindrical tube 1 so as to be gas-tight. For this purpose, the circumferential section 23 has circumferential annular grooves in which piston seals 25 and a piston guide strip 27 (all of a design customary in piston-type accumulators) are seated.

Ring elements 29 and 31, both of which are made of a magnetizable material, are present on the circumferential section 21 of reduced exterior diameter of the piston 3. A top view is presented in FIG. 3 of the bottom ring element 31 shown in FIGS. 1 and 2. In FIG. 2, the upper side of the ring element 31 has a series of depressions 33 (not all of which are shown in FIG. 3) extending concentrically over the circumference of the ring element 31. These depressions 33 are in the form of circular depressions of small depth arranged at regular angular distances over the entire circumference. Each of the recesses formed by the depressions 33 serves as seating for a cylindrical permanent magnet element 35. The polar axes of magnet elements 35 extend in parallel with the longitudinal axis 5. The end polar surface of each magnet element adjoins the bottom of the respective depression 33.

The upper ring element 29, shown in the illustrations, is configured to be a mirror image of ring element 31, and has corresponding depressions 33 forming the seats of the opposite polar end surfaces of the permanent magnet elements 35. Consequently, the row of magnet elements is mounted between the ring elements 29 and 31. A threaded ring 37 is screwed onto an exterior threading 39 on the adjacent end of the piston, and holds the ring elements 29 and 31 in contact with the magnet elements 35 and in contact with a sealing element 41. Sealing element 41 is inserted between lower ring element 31 and a shoulder surface 43 forming a planar surface on the transitional area between the circumferential sections 21 and 23 of the piston 3. The sealing element 41 secures the magnet and pole shoe configuration in the event of any impact of the piston 3 on the bottom of the piston housing (not shown in detail).

Figure 2:
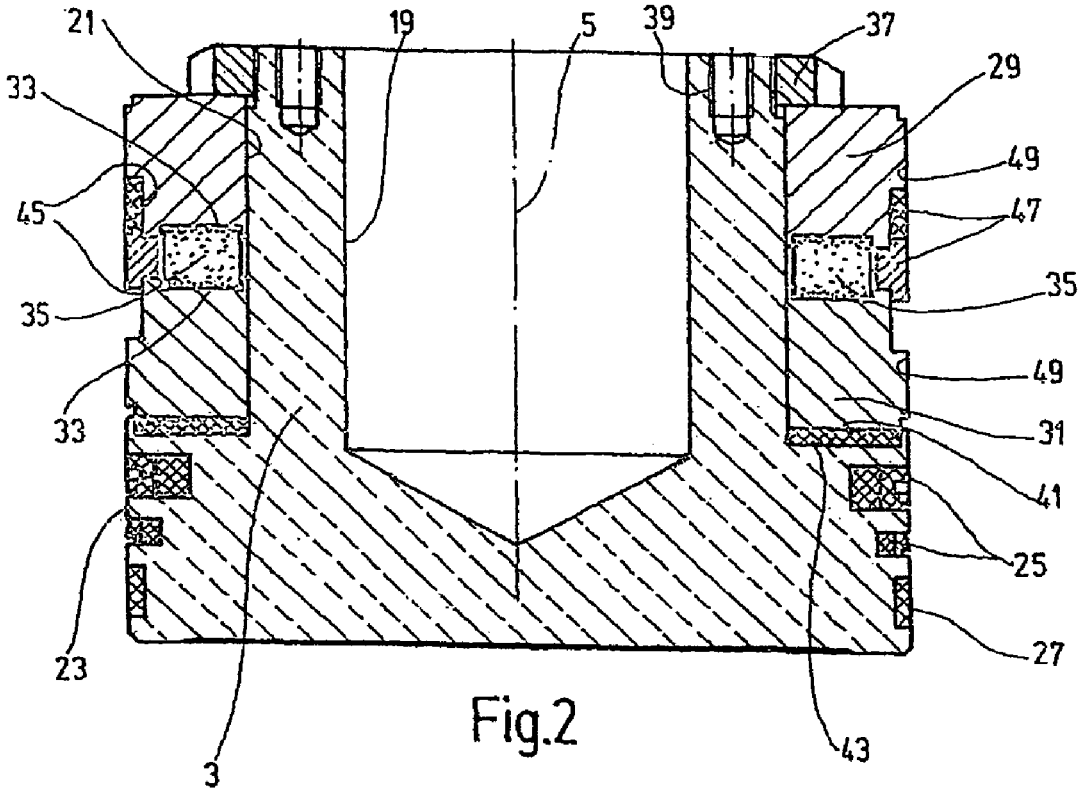
FIG. 2 is a side elevational view in section on a somewhat larger scale of the piston of the exemplary embodiment shown in FIG. 1.
Figure 3:
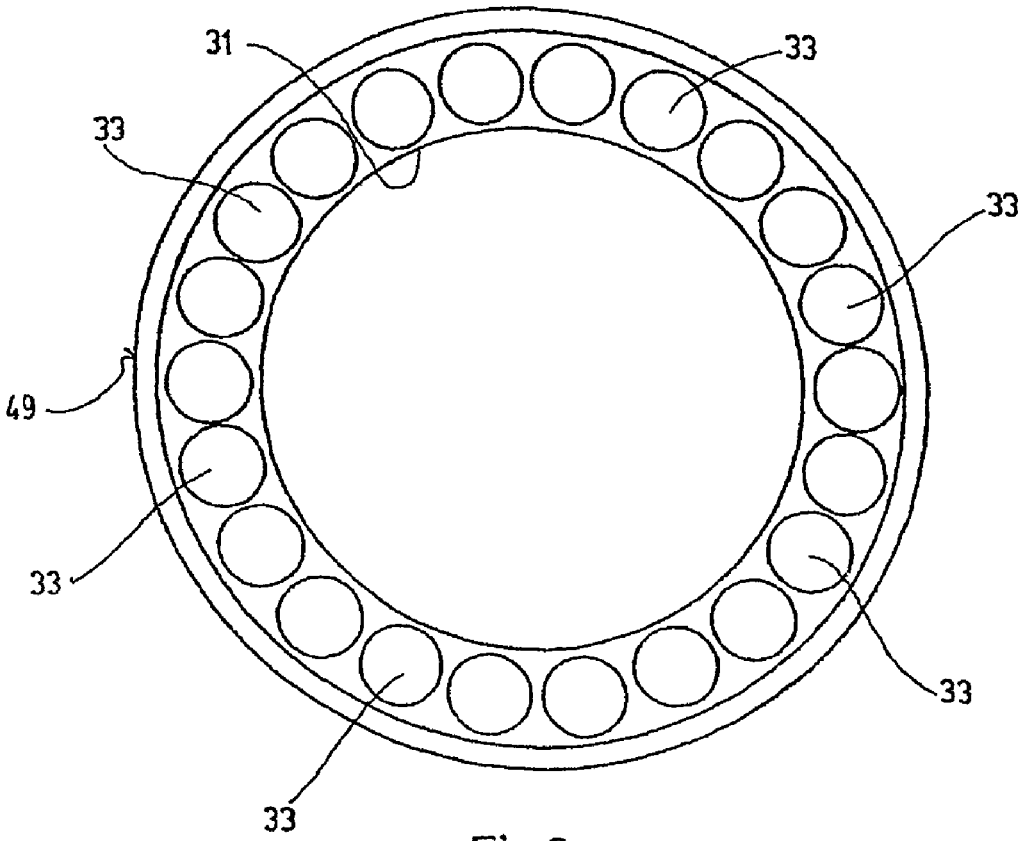
FIG. 3 is a top view on the same scale as that of FIG. 2 of one of the two ring elements positioned on the piston and forming a pole shoe of the magnetic configuration on the piston side of the embodiment of FIG. 1.

As is to be seen in FIGS. 1 and 2, the ring elements 29 and 31 have, in their circumferential area 45 adjoining the magnet elements, an exterior diameter creating a radial spacing from the cylindrical tube 1 so that a free space is formed for receiving non-magnetizable guide and sealing elements 47 (see FIG. 2). In its circumferential area 49 more remote from the magnet elements 35 the exterior diameter of the ring elements 29 and 31 approximates the interior diameter of the cylindrical tube 1. In this configuration, the ring elements 29 and 31 form pole shoes for introduction of the magnetic flux into the wall of the cylindrical tube 1 by way of the circumferential areas 49 approximating it.

As shown in FIG. 1, two Hall sensors 51 are mounted on the exterior of the cylindrical tube 1. These sensors 51 respond to changes in the magnetic field which occur as the piston 3 moves along the path of its stroke in the cylindrical tube 1. As is indicated by the connecting cables 53 of the Hall sensors 51, these sensors 51 are mounted on the cylindrical tube 1 so as to be opposite in orientation. As the piston 3 approaches in its upper end position and its lower end position, a corresponding strengthening of the magnetic field in each instance occurs with different polarity of the field lines on the respective Hall sensor 51. In each instance, the occurrence results in a positive increase in the Hall voltage signal. As shown in FIG. 1, the Hall sensors 51 are mounted at an axial distance from each other such that one Hall sensor 51 is within the area in which the magnet elements 35 are in one end position of the piston 3, while the other Hall sensor 51, having been displaced toward the other end of the cylindrical tube 1, is within an area in which the magnet elements 35 of the piston 3 are in the other end position of the piston.

The Hall voltages generated by the Hall sensors 51 and identifying the position of the piston 3 may be processed by any suitable method in order to obtain indication of the position of the piston 3. Introduction of the magnetic flux of the magnet elements 35 into the wall of the cylindrical tube 1 by way of the ring elements 29 and 31 functioning as pole shoes yield significant signal values based on the Hall effect. The excitation selected for the flux by the ring elements 29 and 31 functioning as pole shoes need be only great enough to obtain adequate signal values. To prevent occurrences of stronger, possibly disruptive, magnetic force effects resulting from the magnetic flux between the magnet configuration on the piston 3 and the cylindrical tube 1, reduction of excitation to values sufficient for display purposes may be provided, for example, by providing a small air gap between the circumferential areas 49 and the cylindrical tube 1 or by introducing between circumferential areas 49 and cylindrical tube 1 a thin wall of piston guide means of a non-magnetizable material.

In a modified embodiment of the piston-type piston-type accumulator according to the present invention, the possibility also exists of omitting the depressions 33. The two ring elements 29 and 31 are then configured to be level on their sides facing each other. The magnet elements 35, configured to be cylindrical, then extend axially between the two planar surfaces of the ring elements 29 and 31 at radial distances from each other. The respective configuration is essentially reproduced in the top view in FIG. 3 if the upper side of the cylindrical magnet elements 35 are assumed in place of the depressions 33.

Only one Hall sensor 51 for monitoring position or determining the piston 3 may also be provided in place of the two Hall sensors shown in FIG. 1. Depending on the function assigned, more than two Hall sensors 51 may also monitor the respective displaced position of the piston 3 and forward signals to appropriate evaluating electronics. Consequently, the solution of the present invention also permits monitoring of the end position of the piston 3 by the two Hall sensors 51 as illustrated in FIG. 1.

While one embodiment has been chosen to illustrate the invention, it will be understood by those skilled in the art that various changes and modifications can be made therein without departing from the scope of the invention as defined in the appended claims.

What is claimed:

1. A piston accumulator, comprising:

an accumulator housing forming a cylindrical tube of magnetizable material and defining an axial direction along a longitudinal axis thereof, said housing having a gas space and a hydraulic fluid space;

a piston axially movable along a stroke path in said cylindrical tube and forming a movable separating element separating said spaces in said housing, said piston having radially smaller and larger circumferential sections spaced from and engaging said cylindrical tube, respectively, and having a radially extending shoulder surface extending between said smaller and larger circumferential sections, said smaller circumferential section located on an end of said piston opening on said gas space, said larger circumferential section defining an opposite end of said piston facing said fluid space;

a magnet arrangement mounted on and about said smaller circumferential section of said piston and generating a field on said cylindrical tube, said magnet arrangement including first and second annular rings of magnetizable material and a plurality of magnet elements with pole end surfaces between said annular rings with said pole end surfaces abutting said annular rings, said second annular ring being supported on said shoulder surface to support said magnet arrangement in a direction of said hydraulic fluid space; and a magnet field sensor positioned in an exterior of said cylindrical tube and including a first Hall sensor generating signals representative of piston positions along said stroke path in response to said field generated by said magnet elements.

2. A piston accumulator according to claim 1 wherein said magnet field sensor comprises a second Hall sensor mounted on said exterior of said cylindrical tube spaced an axial distance from said first Hall sensor.

3. A piston accumulator according to claim 2 wherein said Hall sensors are in axial positions corresponding to specific positions of said piston along said stroke path.

4. A piston accumulator according to claim 3 wherein said specific positions correspond to end positions of said piston along said stroke path.

5. A piston accumulator according to claim 1 wherein said piston is of non-magnetizable material; and said magnet elements are permanent magnets radially spaced from said smaller circumferential section of said piston and arranged in a row concentric with said longitudinal axis, said permanent magnets having same polarities relative to each other and having polar axes parallel to said longitudinal axis.

6. A piston accumulator according to claim 5 wherein said permanent magnets are circular cylinders with said polar axes thereof along axes of said circular cylinders, and are spaced from one another at equal angular distances about a circumference of said piston.

7. A piston accumulator according to claim 6 wherein said annular rings have exterior circumferential surfaces adjacent said permanent magnets radially spaced from said cylindrical tube and exterior circumferential surfaces remote from said permanent magnets with exterior diameters approximating an interior diameter of said cylindrical tube forming pole shoes to introduce magnetic flux into said cylindrical tube.

8. A piston accumulator according to claim 7 wherein a threaded ring is engaged with a threading on said piston to hold said annular rings together on said smaller circumferential section.

9. A piston accumulator according to claim 1 wherein a sealing element is between and engages said second annular ring and said shoulder surface.

10. A piston accumulator, comprising:

an accumulator housing forming a cylindrical tube of magnetizable material and defining an axial direction along a longitudinal axis thereof, said housing having a gas space and a hydraulic fluid space;

a piston of non-magnetizable material axially movable along a stroke path in said cylindrical tube and forming a movable separating element separating said spaces in said housing, said piston having radially smaller and larger circumferential sections spaced from and engaging said cylindrical tube, respectively, and having a radially extending shoulder surface extending between said smaller and larger circumferential sections, said smaller circumferential section located on an end of said piston opening on said gas space, said larger circumferential section defining an opposite end of said piston facing said fluid space;

a magnet arrangement mounted on and about said smaller circumferential section of said piston and generating a field on said cylindrical tube, said magnet arrangement including first and second annular rings of magnetizable material and a plurality of magnet elements with pole end surfaces between said annular rings with said pole end surfaces abutting on said annular rings, said second annular ring abutting a sealing element on and engaging said shoulder surface to support and engage said magnet arrangement in a direction of said hydraulic fluid space, said magnet elements being permanent magnets radially spaced from said smaller circumferential section of said piston and arranged in a row concentric with said longitudinal axis, said permanent magnets having same polarities relative to each other and having polar axes parallel to said longitudinal axis, said permanent magnets being circular cylinders with said polar axes thereof along axes of said circular cylinders and being spaced from one another at equal angular distances about a circumference of said piston, said annular rings having exterior circumferential surfaces adjacent said permanent magnets radially spaced from said cylindrical tube and exterior circumferential surfaces remote from said permanent magnets with exterior diameters approximating an interior diameter of said cylindrical tube forming pole shoes to introduce magnetic flux into said cylindrical tube; and a magnet field sensor positioned in an exterior of said cylindrical tube and including a first Hall sensor generating signals representative of piston positions along said stroke path in response to said field generated by said magnet elements.

11. A piston accumulator according to claim 10 wherein said magnet field sensor comprises a second Hall sensor mounted on said exterior of said cylindrical tube spaced an axial distance from said first Hall sensor.

12. A piston accumulator according to claim 10 wherein a threaded ring is engaged with a threading on said piston to hold said annular rings together on said smaller circumferential section.

13. A piston accumulator according to claim 10 wherein said Hall sensors are in axial positions corresponding to specific positions of said piston along said stroke path.

14. A piston accumulator according to claim 13 wherein said specific positions correspond to end positions of said piston along said stroke path.

* * * * *